US005920970A

United States Patent [19]

Coblentz

[11] Patent Number: 5,920,970

[45] **Date of Patent: *Jul. 13, 1999**

[54] METHOD MAKING AN ANTI-SLIP LACE

[75] Inventor: Thomas L. Coblentz, Rockford, Ill.

[73] Assignee: Nobbits, Inc., Rockford, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,920

[22] Filed: Nov. 5, 1997

[51] Int. Cl.[6] ..... A43C 1/00; A43C 7/00

[52] U.S. Cl. ..... 24/713; 24/712; 87/9; 87/6; 2/270; D2/978

[58] Field of Search ..... 24/712, 713, 713.1, 24/713.4; D2/978; 87/9, 10, 1, 6; 2/270

[56] References Cited

U.S. PATENT DOCUMENTS

| | | | |
|---|---|---|---|
| 1,476,348 | 12/1923 | Miller | 24/713 X |
| 1,804,211 | 5/1931 | Daniels et al. . | |
| 2,141,801 | 12/1938 | Taft . | |
| 2,306,515 | 12/1942 | Wright . | |
| 2,477,151 | 7/1949 | Stapleton . | |
| 2,639,481 | 5/1953 | Lester . | |
| 3,059,518 | 10/1962 | Nelson . | |
| 3,110,945 | 11/1963 | Howe, Jr. | 24/713 |
| 3,518,730 | 7/1970 | Cupler, II . | |
| 3,922,455 | 11/1975 | Brumlik . | |
| 4,247,967 | 2/1981 | Swinton . | |
| 5,272,796 | 12/1993 | Nichols | 24/713 X |
| 5,341,758 | 8/1994 | Strickland | 87/6 |
| 5,673,546 | 10/1997 | Abraham et al. | 24/713 X |
| 5,690,014 | 11/1997 | Larkin | 87/9 X |
| 5,712,010 | 1/1998 | Russek et al. | 87/9 X |

FOREIGN PATENT DOCUMENTS 557418 8/1932 Germany .

OTHER PUBLICATIONS

U.S. Trademark Registration No. 2,048,460, registered Mar. 25, 1997 for a shoe lace product configuration owned by Nobbits Inc. (previously PDA Incorporated).

U.S. Trademark Registration No. 2,048,462, registered Mar. 25, 1997 for a shoe lace product configuration owned by Nobbits Inc. (previously PDA Incorporated).

*Primary Examiner*—James R. Brittain
*Assistant Examiner*—Robert J. Sandy
*Attorney, Agent, or Firm*—Leydig, Voit & Mayer, Ltd.

[57] ABSTRACT

Method of making an anti-slip lace for tying wearing apparel items such as shoes comprises an elongated woven tubular member that has internal spaced raised projections along its length wherein the raised projections are blobs of acrylic paint and a round lace is formed by inverting a flat woven tubular lace that had the paint blobs applied to the exterior surface.

6 Claims, 1 Drawing Sheet

METHOD MAKING AN ANTI-SLIP LACE

FIELD OF THE INVENTION

The present invention relates generally to laces or ties such as used for shoes and other items of wearing apparel, and more particularly relates to laces which have anti-slip or holding arrangements that coact with either eyelets, hooks or the laces themselves to keep the laces tied and in place.

BACKGROUND OF THE INVENTION

Woven tubular flat and round shoe laces have been available for a great many years. See, for example, Daniels et al. U.S. Pat. No. 1,804,211, issued May 5, 1931. Workers in the art have over the years devised a number of modifications for maintaining lacing snugness on the shoe and at the tie knot area of the lace to provide an anti-slip lace. Examples of such laces are seen in Taft U.S. Pat. No. 2,141,801, issued Dec. 27, 1938 (spaced internal beads disposed inside the tubular lace); Wright U.S. Pat. No. 2,306,515, issued Dec. 29, 1942 (raised surface areas provided by staples and an internal stiffening member adjacent the lace ends); Stapleton U.S. Pat. No. 2,477,151, issued Jul. 26, 1949 (a stand of material woven back and forth through the lace); Lester U.S. Pat. No. 2,639,481, issued May 26, 1953 (spaced protuberances formed by weaving lengths of thread through the lace along its length); Nelson U.S. Pat. No. 3,059,518, issued Oct. 23, 1962 (braided elastic strands); Brumlik U.S. Pat. No. 4,247,967, issued Feb. 3, 1981 (male and female "Velcro" hook and loop strips along opposite ends of the lace); and German Patent No. 557,418, issued Aug. 23, 1932 (a strip of material painted or printed along the length of the lace).

Still another approach is shown in U.S. Pat. No. 3,518,730, issued Jul. 7, 1970, where a monoform lace has an abrasive grit within the binder to provide a roughened surface finish.

More recently, a commercial lace product produced by Nobbits, Inc. of Rockford, Ill., the assignee of this application, has blobs of an acrylic paint applied in spaced intervals along one side or alternating on opposite sides of a flat tubular woven lace. Such laces do provide the desired latching functions with eyelets or hooks on shoes or other wearing apparel items and the laces also provide a distinctive appearance or looks particularly when the paint blobs are a contrastingly or differently colored material from that of the laces themselves.

The Nobbits® brand laces are most commonly 9 mm flat woven material such as polyester, nylon, cotton or blends with an acrylic paint blob applied to the exterior surface in spaced intervals, preferably in an alternating manner of disposition on opposite sides of the laces. The laces are preferably provided with an aglet at each end.

Despite the existence of the aforementioned lace constructions disclosed in prior patents and the commercially available Nobbits latching laces, it is desirable to provide a round lace which appears conventional, but yet still has the benefits of such laces insofar as the latching feature is concerned.

BRIEF SUMMARY OF THE INVENTION

The present invention provides a round lace that is conventional in appearance, yet the lace has the capabilities of a latching action to hold firmly at eyelets and hooks and to remain securely tied without becoming easily loosened or untied at the bow area.

The lace of the present invention has been found to be readily produced by inverting tubular flat laces having paint blobs or projections on its surface at spaced intervals so that upon inversion the projections are on the interior surface and a substantially round lace occurs, particularly upon stretching of the lace.

The substantially round laces thus formed with interior surface projections on the tubular lace member can be conveniently and economically made with otherwise scraps resulting in the application of acrylic paint blobs to the exterior surface of flat tubular laces. Since the application of paint may smudge or even bleed through the lace material resulting in otherwise rejects, the inverting of the laces provides a utilizable product that is a round lace with the latching benefits desired. Preferably, the same color paint blobs as the lace member are used, but a useful product can also occur with contrasting color blobs after inversion.

The round laces having internal spaced projections providing the latching feature are desirable for hiking or walking boots, sports shoes, shoe skates, ski boots and wearing items that have laces which require a firm non-slip hold and good retention to the tied off area. For example, support braces for various parts of the body use are excellent candidates for using such laces.

Preferably, 5 mm or less for round lace is desirable so that reversing of a 9 mm flat lace will approximately provide a satisfactory round lace.

The foregoing described features and benefits of the invention and other features or advantages will be appreciated as this description proceeds, and it will be apparent to those skilled in the art that modifications may be made in the structure without departing from the spirit or scope of the invention as set forth in the appended claims.

DETAILED DESCRIPTION OF THE PREFERRED EMBODIMENTS

Figure 1:
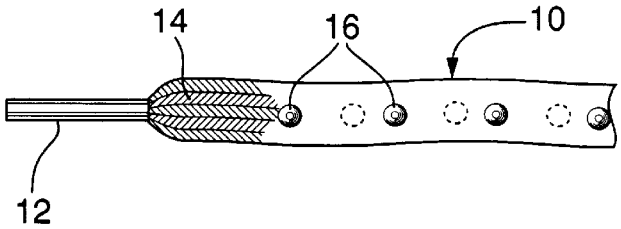
FIG. 1 Prior Art
FIG. 1 is a fragmentary view of a prior art flat tubular woven lace that has spaced projections alternating on opposite sides and which can be used to provide a lace of the present invention.

Referring now to the drawings, there is shown in FIG. 1, a commercially available and prior art lace 10 having aglets 12 at each end and a tubular flat woven elongated lace member 14 of a predetermined length. Blobs or projections 16 such as provided by the application of drops of an acrylic paint are disposed at spaced intervals along the outside surface length of the tubular member 14. The blobs or projections 16 applied to the surfaces of the flat tubular lace member 14 provide a latching effect with respect to shoe eyelets or hooks and in the bow tying area of the lace. The paint blobs can be amorphous as resulting from a drop application or they can be given any desired shape or form such as by molding or printing techniques.

Figure 2:
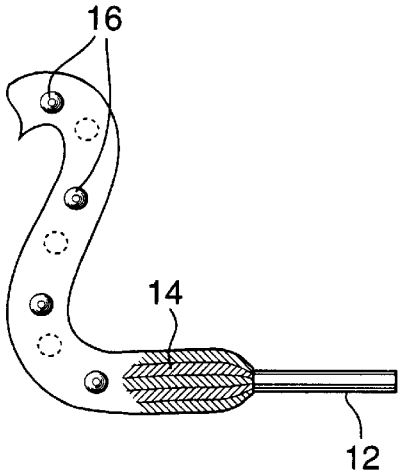
FIG. 2 is a sectional side view of a lace as in FIG. 1 showing one aglet end cut off and the inversion taking place.
Figure 2:
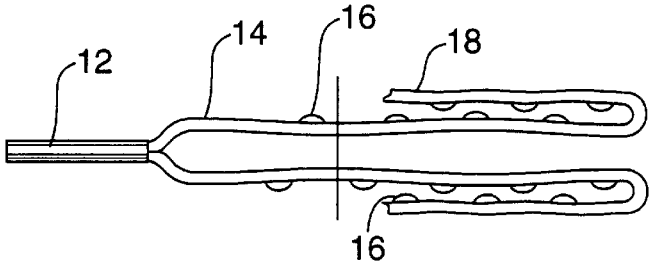
Figure 3:
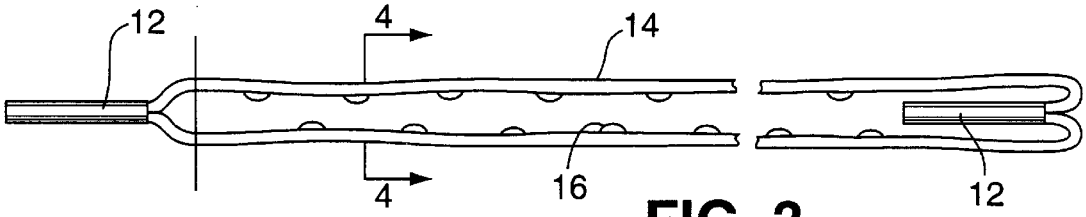
FIG. 3 is a sectional side view of a completely inverted lace.

Referring to FIG. 2, there is shown a lace 14 like that of FIG. 1 where the aglet 12 at the right side has been cut off and the tubular end 18 is being inverted by drawing the left side of the lace through its center. As shown in FIG. 3 upon completion of the inversion and addition of another aglet on the left side, the blobs or projections 16 are now on opposition side portions of the interior surface of the tubular member 14. The now right side aglet 12 is also on the interior and that end can be sealed or cut off and a new exterior aglet added.

Figure 4:
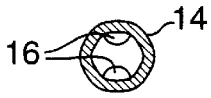
FIG. 4 is a sectional view taken along the line 4—4 in FIG. 3.
Figure 5:
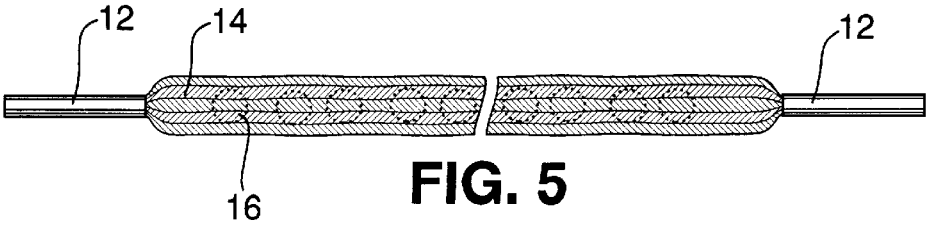
FIG. 5 is a fragmentary view of a lace according to the present invention.

The inverted tubular member 14 now assumes a substantially round shape as shown in FIG. 4. As shown in FIG. 5, the exterior of the lace appears fairly conventional as a round lace, but it retains the anti-slip features and benefits.

Figure 6:
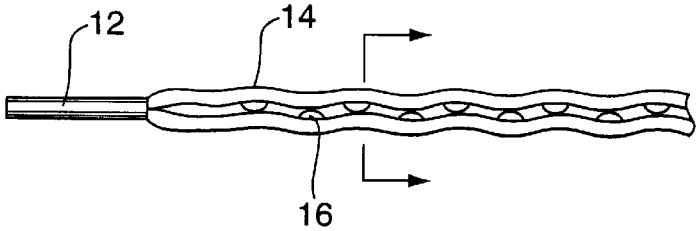
FIG. 6 is a fragmentary view of a lace as in FIG. 5 here showing the stretched shaping of the lace.

In FIG. 6, there is shown the effect of tension stretching of the lace such as when it is used on a shoe or other wearing item. The application of tension draws the tubular member diameter inwardly and the projections 16 on the interior surface provide the support that helps give the lace a continued round shape as well as providing stops or bumps forming on the exterior surface that give the desired latching effect for the lace.

What is claimed is:

1. The method of making an anti-slip lace for tying wearing apparel items comprising the steps of providing an elongated woven flat tubular lace member having exterior and interior surfaces, applying raised projection blobs of acrylic paint at spaced intervals along the external surfaces, and inverting the tubular member so that the raised projection blobs are on the interior surface of the finished lace.

2. A lace as claimed in claim 1 wherein the paint blobs are amorphous in shape.

3. The method as claimed in claim 1, wherein said blobs are applied on alternating opposite exterior side surfaces of the flat tubular lace member.

4. A lace as claimed in claim 1 wherein the blobs are contrasting colors to that of the woven tubular member.

5. The method as claimed in claim 1 wherein aglets are provided at opposite ends of the tubular member.

6. The method as claimed in claim 5 wherein one of said aglets is removed prior to inversion of the blob applied tubular member and an aglet is applied to the free end after inversion of the tubular member.

* * * * *